US006089478A

United States Patent [19]

Truan et al.

[11] Patent Number: 6,089,478

[45] Date of Patent: Jul. 18, 2000

[54] SPREADER ASSEMBLY

[75] Inventors: Charles Joseph Truan, Royal Oak; James Phillip Truan, Berkley; Timothy William Hewitt, Pleasant Ridge, all of Mich.

[73] Assignee: Trynex, Inc., Royal Oak, Mich.

[21] Appl. No.: 09/082,833

[22] Filed: May 21, 1998

Related U.S. Application Data

[60] Provisional application No. 60/047,639, May 22, 1997, and provisional application No. 60/065,834, Nov. 17, 1997.

[51] Int. Cl.[7] ..... E01C 19/20

[52] U.S. Cl. ..... 239/675; 239/661; 239/663; 239/677; 239/687

[58] Field of Search ..... 239/172, 289, 239/661, 663, 672, 675, 681, 684, 687, 677; 296/50–55; 224/404, 500, 509, 513, 533, 544, 553

[56] References Cited

U.S. PATENT DOCUMENTS

| | | | |
|---|---|---|---|
| 3,819,120 | 6/1974 | Walker | 239/684 X |
| 4,166,581 | 9/1979 | Hetrick | 239/687 X |
| 4,712,717 | 12/1987 | Egerdahl | 239/687 X |
| 5,018,668 | 5/1991 | Bauer | 239/675 X |
| 5,361,988 | 11/1994 | Nelson | 239/687 X |
| 5,375,773 | 12/1994 | Lewis | 239/687 X |
| 5,649,666 | 7/1997 | Lewis | 239/675 X |

OTHER PUBLICATIONS

Meyer Mini Spreader Brochure, 1996.
Sno–Way International, Inc. Snow And Ice Control Products Brochure.
Sno–Way Engineering Introduces "The Better Spreader" OPTA–FLOW Brochure.
Western Products, Western Spreaders Brochure.
Western Products, Low Profile, Dual Swing Away Tailgate Spreader Brochure.
Fisher, Speed–Caster 2 Stage, Brochure.
Fisher, Low Profile, Dual Swing Away Tailgate Spreader, Brochure, 1997.
Buyers, Low Profile Tailgate Spreader, Brochure.
Buyers, TGS01 Tailgate Spreader, Information Brochure.

*Primary Examiner*—Andres Kashnikow
*Assistant Examiner*—Steven S. Ganey
*Attorney, Agent, or Firm*—Howard & Howard

[57] ABSTRACT

A spreader assembly for spreading materials such as, for example, salt seed or fertilizer. The spreader assembly includes a motor and transmission drive assembly which is mounted outside of the hopper to protect the motor and drive assembly from corrosive materials in the hopper. The transmission motor assembly allows a small motor with high revolutions per minute to be used and still supply the necessary torque needed to properly spread material. The spreader assembly also includes a modular mounting frame system which allows the frame to be mounted to vehicles of different sizes. The frame allows pivoting of the spreader about one axis and latching to a latching bar to secure the spreader assembly in the latched position. Rail mounting brackets are disclosed which permit mounting of the frame to the bed rails of a vehicle without the need to drill holes in to the bed rail. A rub bar is provided to prevent the spreader assembly from being pivoted when the hopper is full of material which could lead to damage to the support frame or vehicle. A unique top is provided to cover the hopper. The top employs the air flow over the top to prevent the top from being blown off of the hopper.

5 Claims, 5 Drawing Sheets

SPREADER ASSEMBLY

This application claims priority to a provisional application filed on May 22, 1997, application number 60/047,639 and a provisional application filed on Nov. 17, 1997, application number 60/065,834.

BACKGROUND OF THE INVENTION

The present invention generally relates to spreaders and more particularly, to an improved spreader which uses a transmission drive assembly.

Conventional spreaders employ a spinner drive assembly which is mounted within the hopper. The hopper receives and stores, for example, salt or other materials to be spread. The drive assembly includes a drive housing and motor assembly mounted inside the hopper. The motor assembly includes a motor, two drive pulleys connected by a drive belt, and a bearing assembly. Mounted to one of the pulleys and journaled within the bearing assembly is a drive shaft which has an auger attached adjacent the free end of the shaft. All of these elements are mounted within the hopper and typically are surrounded by salt. To reduce corrosion of the assembly, a motor cap is mounted over the motor assembly.

The shaft typically extends out of the base of the hopper and a spinner is mounted to the shaft. The free end of the shaft is journaled within a second bearing mounted to a H-frame assembly. In operation, salt is placed in the hopper and the auger pulls salt through the bottom opening in the hopper where it contacts the spinner and is thrown out over a predetermined radius.

These types of spreaders experience several problems. First, since the motor assembly is mounted inside of the hopper, it is susceptible to corrosion. The motor typically is surrounded by highly corrosive salt which tends to corrode the motor assembly. Additionally, the shaft has to be fairly long in order to extend from the motor assembly through the H-frame and be mounted within the bearing. As a result of the length of the shaft, the bearings experience a large amount of stress and are highly susceptible to failure. Further, the ability to repair the system is difficult because the motor assembly is mounted within the housing and must be removed for repair. Any belts which need to be replaced must be replaced within the hopper or the motor assembly must be removed. A still further problem is corrosion of the shaft since that shaft is always within the salt or other material held within the hopper. A further problem with these types of systems is the inability to lubricate the bearings, particularly the bearing which is mounted in the hopper. Without proper lubrication, these bearings fail and must be replaced. Because of the difficulty in lubricating the bearings, the bearings experience a high failure rate.

Another disadvantage of known spreaders is the need for a large motor to drive the auger and spinner. These motors are heavy, expensive and do not experience long operational lives.

A still further problem with conventional spreader assemblies is the time required to install them on a vehicle and the damage done to the vehicle when the units are installed. Common spreader frame structures are difficult to install. The various components of the frame structure have to be properly positioned and then holes drilled into the truck bed or rails and bumper. Several hours are required for a typical assembly. Additionally, the spreader support frames are designed for a particular vehicle which creates the need for large inventories of frames to fit various vehicles.

Other problems with swing-away spreaders is the damage that can be done to the spreader assembly and the vehicle when a loaded spreader is pivoted. As will be appreciated, with a hopper full of salt, the weight in the pivoted position is supported only by the pivot rod which can result in the pivot rod the bumper or the support frame being bent. Another problem with all known spreaders is that the hopper top has a tendency to blow off due to air blowing over the vehicle.

BRIEF DESCRIPTION OF THE PRESENT INVENTION

The present invention overcomes the above problems found in known spreaders and provides many advantages.

The spreader assembly of the present invention has a hopper for containing material to be spread. The hopper has a discharge outlet at its bottom. A drive mechanism for auguring material from the hopper through the outlet and then distributing the material is mounted below the hopper. The drive assembly has a drive shaft, to which an auger is mounted and extends into the discharge of the hopper. A spinner is mounted to the drive shaft below the auger to receive material as it is augured out of the outlet. The spinner throws the material over a large distribution area. The drive mechanism includes a motor and a transmission with the transmission reducing the motor revolutions per minute to thereby increase the torque applied to the drive shaft. By using a transmission assembly with the motor, a much smaller, less expensive motor can be employed than is employed with conventional spreaders. In the preferred embodiment, the motor is approximately ⅛ horse power. This compares to typical spreaders which have motors of ¼ to 1 horse power.

In the preferred embodiment of the invention, the motor and transmission are joined as a unit. The transmission is sealed to prevent contaminants from entering the transmission. Further, the transmission and motor assembly are mounted within an enclosure mounted outside of the hopper. The enclosure further protects the motor and transmission assembly from damage and, in particular, from contaminants. The enclosure is sealed by an oil seal to further reduce the ability for contaminants to enter the motor and transmission area. The enclosure itself is mounted to the support frame of the spreader assembly so that the enclosure including the motor and transmission can be quickly and easily removed by removing four bolts. This facilitates easy maintenance and, if necessary, replacement of the motor and transmission assembly. It should be understood by those of ordinary skill in the art that even though the motor and transmission are preferably a single unit, the motor and transmission can be disconnected from one another so that repairs can be made to either, or either can be replaced, if necessary.

The spreader of the present invention has a unique mounting frame which allows rapid attachment of the spreader to vehicles of different sizes. The hopper support frame includes a main spreader frame to which the hopper is mounted. This main spreader frame includes at least one main channel and at least one adjustable channel mated with the main channel to allow the adjustable channel to move with respect to the main channel to extend or retract the overall width of the hopper support frame. In this way, the hopper support frame can be positioned on the rear of the vehicle, for example a pick-up truck, and the adjustable channels extended to the edge of the vehicle for connection to a pivot rod, latching bar or other connecting means. In the preferred embodiment, there are two main channels and each main channel receives two adjustable channels. The adjustable channels are on opposite sides of each main channel. In this way, the main channel can be positioned on the center of the vehicle and the adjustable channels extended to each edge of the vehicle.

In the preferred embodiment, there are bumper mounting brackets which are bolted to the bumper of the vehicle and connected to the adjustable channels. In the preferred embodiment, there is a pivot rod on one side of the vehicle and a latch bar on the opposite side. The pivot rod and latch bar extend upwardly from the bumper mounting brackets and interconnect to the adjustable channels. On the pivot rod side, the adjustable channels have sleeves which journal upon the pivot rod and allow the spreader frame to pivot with respect to the vehicle. This is particularly advantageous when the spreader is mounted to the rear of a pick-up truck. The spreader can be pivoted about the pivot rod to provide access to the tailgate of the pick-up truck.

Opposite the pivot rod, there is a latch bar which allows the spreader frame to be securely latched in place. In the disclosed embodiment, the adjustable channels on the latch bar side of the support frame have latches which are U-shaped members attached to the free ends of the adjustable channels. A locking pin is slidably mounted within the adjustable channels and each latch bracket has two holes which receive the pins. The pins are mounted in an L-shaped groove which allows the pins to be moved from a locked position to a release position. The latch bar has two holes, one for each latch bracket. In this way, to latch the spreader frame to the latch bar, the spreader frame is closed engaging the latching brackets about the latch bar and then the pins can be slid through the now three mating holes to latch the spreader frame in the latched position. It should be understood by those of ordinary skill in the art that a single latch mechanism could be used and other types of latch mechanisms could be used without departing from the overall scope of the present invention.

To further secure the spreader assembly, to the rear of a pick-up truck for example, rail mounting brackets are used. Unlike traditional spreaders, the rail mounting brackets of the present invention do not require the drilling of holes into the bed or rails of the pick-up truck. The mounting brackets of the present invention have a body portion with an underside lip, a generally U-shaped lip, which fits under the bed rail. The body portion rests on top of the bed rail and the lip is received on the bottom of the bed rail. Fasteners, such as for example bolts are threaded through the underside lip and engage the underside of the bed rail to secure the rail mounting brackets in place. To further secure the brackets, a slotted opening is formed in the body portion for receipt of a toggle bolt. The toggle bolt engages the stake pocket of the pick-up truck and further secures the bracket in place.

Each rail mounting bracket is connected to either the pivot rod or the latch bar. In order to facilitate the easy installation of the spreader assembly of the present invention to a vehicle, the pivot rod and latch bar are pivotally connected to the rail mounting brackets. In this way, the bumper brackets and rail brackets can be pivotally adjusted with respect to one another to ensure proper level mounting of the assembly to the vehicle.

The spreader assembly of the present invention also includes a rub bar which prevents the spreader from being pivoted with respect to the vehicle unless the hopper is substantially empty. The pivot bar is mounted on the bottom of the spreader frame and engages one or both of the bumper mounting brackets. Additionally, if desired, a separate rub bracket can be mounted to the bumper to engage the rub bar. In order to pivot the spreader assembly, the spreader assembly must be raised to lift the rub bar off of the surface upon which it rests. Without lifting the spreader assembly, the rub bar engages the surface upon which it rests to prevent pivoting of the assembly. In this way, if the hopper is filled, it is too heavy to be lifted and therefore cannot be pivoted. The bumper mounting brackets also include a stop to prevent the spreader assembly from being pivoted beyond a pre-determined distance to avoid the hopper from smashing into the side of the vehicle as it is pivoted.

A further advantage of the present invention is the use of an aerodynamically designed top which is not susceptible to being blown off of the hopper as the vehicle is in use. The top of the hopper has a front side which is sloped upwardly and rearwardly and meets with the rear side which is sloped upwardly and forwardly to define a crest. In addition to the front and rear sloping sides, the sides of the top are sloped upwardly and inwardly. In this way, as air is flowing over the top, the top is forced downwardly on to the hopper instead of being blown off of the hopper which is common with traditional spreader assemblies.

It will be apparent to one of ordinary skill that other embodiments could be used to obtain similar results and objectives and still be within the scope of the invention. With reference to the following brief description of the drawings and disclosure, the invention will be described.

DETAILED DESCRIPTION OF THE INVENTION

Figure 1:
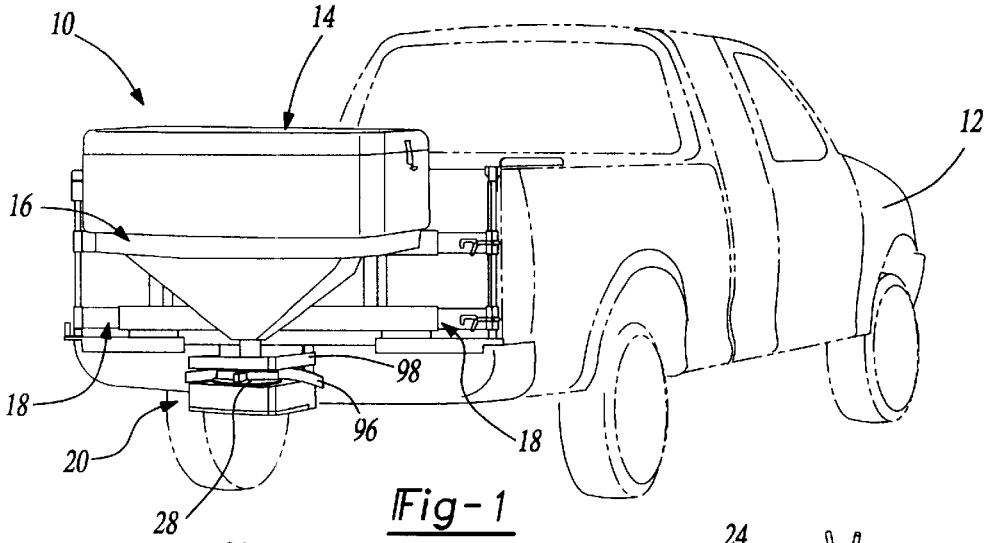
FIG. 1 is a rear perspective view of a pick-up truck having the spreader assembly of the present invention mounted to the rear.

The spreader of the present invention is shown generally at 10 in FIG. 1. The spreader 10 is ideally suited for spreading salt, seed, fertilizer, etc. As illustrated, the spreader 10 is mounted to a vehicle such as, for example, the rear of a pick-up 12. The spreader 10 includes a hopper 14 which is mounted to a main spreader frame 16 which is mounted to a mounting frame 18. In the preferred embodiment, the vehicle mounting frame 18 pivots with respect to the rear of the pick-up truck 12 so that the hopper 12 can be pivoted to allow the tail gate of the pick-up truck 12 to be opened and closed without having to remove the spreader 10.

Figure 2:
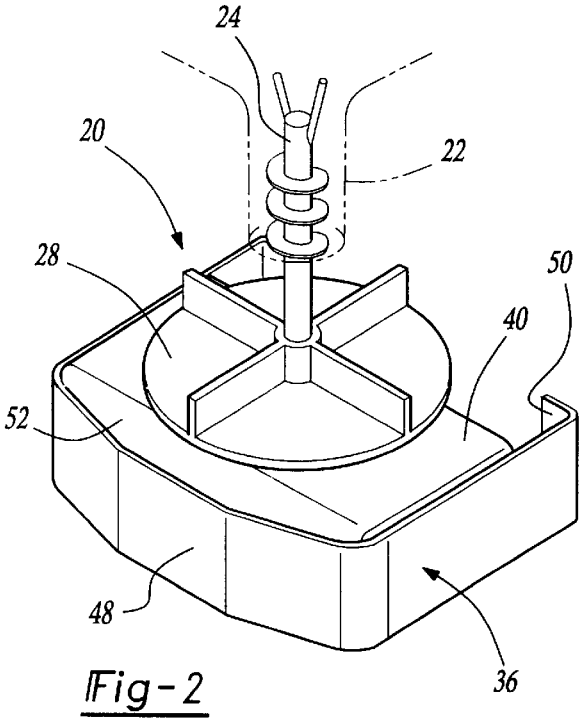
FIG. 2 is a perspective view of the drive assembly of the present invention.
Figure 3:
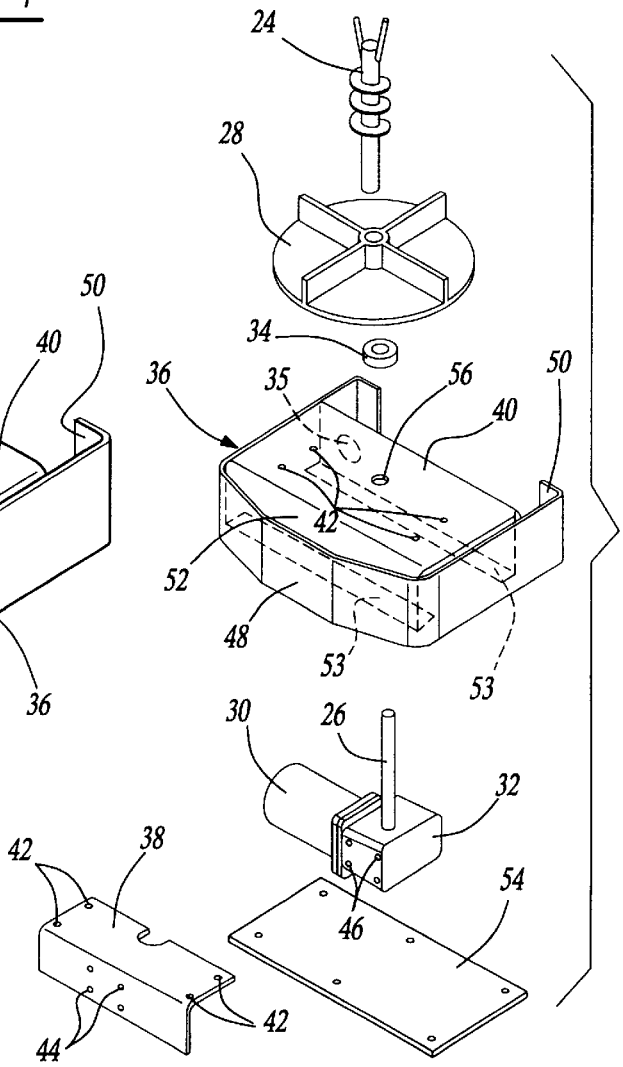
FIG. 3 is a perspective exploded view of the drive assembly of the present invention.
Figure 4:
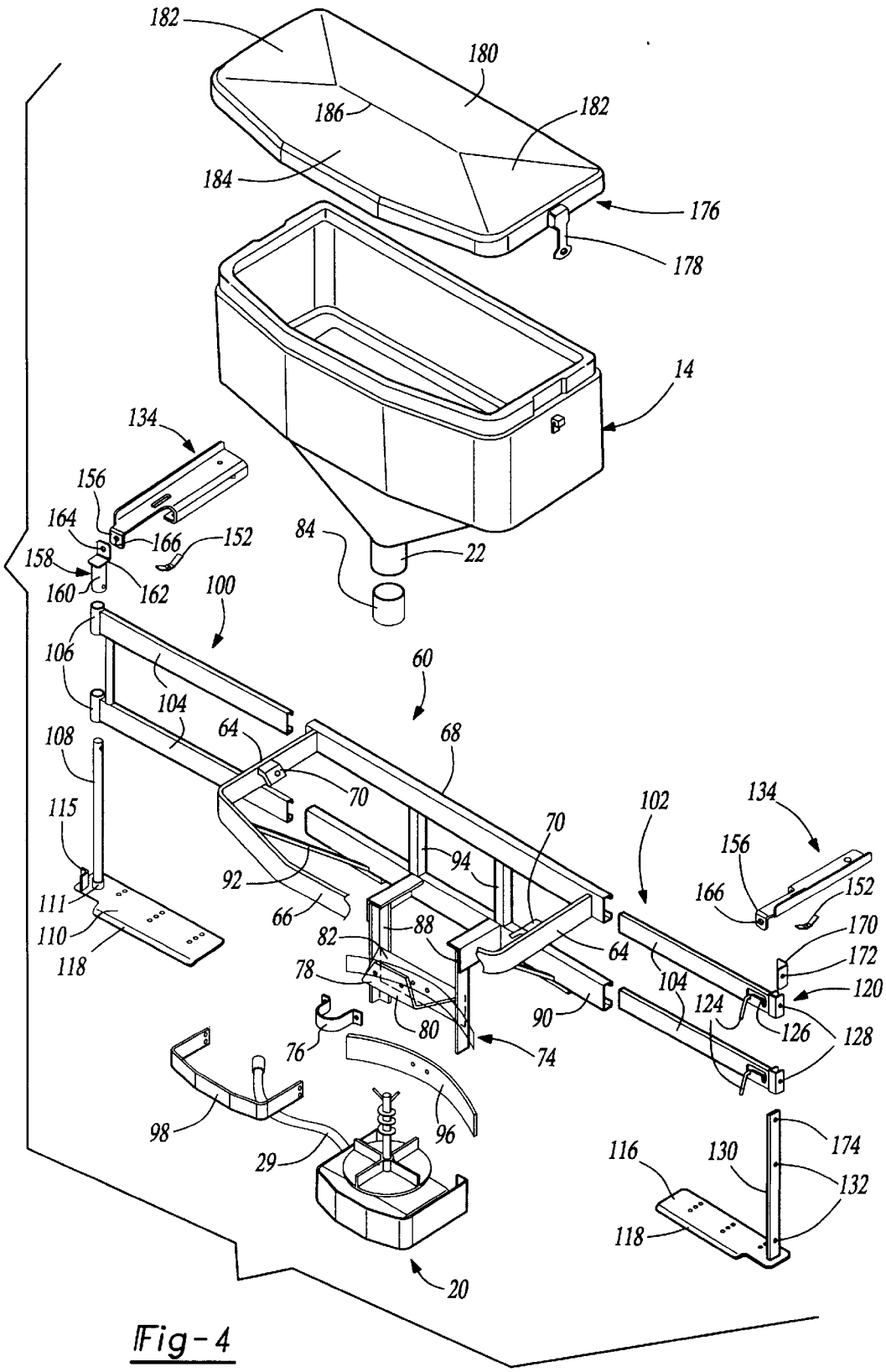
FIG. 4 is a perspective exploded view of the spreader assembly of the present invention.

The spreader 10 includes a drive assembly 20 that is mounted below the hopper 14. With reference to FIGS. 2 and 3, the hopper 14 has a hopper outlet 22 that receives an auger 24 mounted to a shaft 26 which is connected to the drive assembly 20. A spinner 28 is mounted between the auger 24 and the drive assembly 20. The auger 24 and spinner 28 are mounted to the shaft 26 so that they can spin together. In the preferred embodiment, the drive assembly 20 is controlled from the cab of the vehicle. With reference to FIG. 4, a control cable 29 containing the electrical wiring is illustrated. In the preferred embodiment, the cable 29 is plugged into a receptacle at the rear of the vehicle which in turn is wired to the controls in the cable. When the drive assembly 20 is started, the shaft 26 is spun which spins the auger 24 and the spinner 28. The auger 24 is mounted within the hopper outlet 22 and when spun draws the contents of the hopper down against the spinner 28 to spread the material over a wide distribution area.

With reference to FIG. 3, the drive assembly of the present invention will be described in greater detail. Drive assembly 20 includes a motor 30 connected to a transmission 32. In the preferred embodiment of the present invention, the motor 30 and transmission 32 are a sealed unit and comprise a single assembly. This is preferred because of the corrosive nature of the environment in which these spreaders typically operate and the corrosive nature of some of the materials being spread. The single sealed unit reduces the ability for corrosive materials to enter the transmission or motor which could foul the drive assembly 20. It is also preferred to seal the transmission and to provide a sealed oil bath or sealed grease reservoir to lubricate the transmission bearings or gears or both. To further protect the drive assembly, an oil seal 34 is mounted between the spinner 28 and the drive enclosure 36.

A drive mount 38 connects the transmission 32 to the drive enclosure 36. The drive enclosure 36 has a mounting plate 40 to which the drive mount 38 is mounted. As illustrated, there are mating mounting holes 42 in the drive mount 38 and the mounting plate 40 to receive bolts or screws. The drive mount has bolt holes 44 which mate with bolt holes 46 in the transmission 32 for receipt of mounting bolts.

The enclosure 36 has outer walls 48 which in the illustrated embodiment number five and an attaching flange 50. The attaching flange 50 allows the drive assembly 20 to be bolted or screwed to the main spreader frame 16. The outer walls 48 protect the motor 30 and the transmission 32 from damage from such as for example backing the spreader 10 into something. Within the outer walls 48 their are inner walls 52. The inner walls 52, mounting plate 40, and cover plate 54 enclose the motor 30 and the transmission 32 to further protect them from damage and the elements. In the disclosed embodiment, the cover plate 54 is bolted or screwed to the flanges 53. As shown, the mounting plate 40 has an opening 56 that receives the shaft 26 and the oil seal 34 fits over the shaft and seals the opening 56 to prevent the ingress of contaminants. An opening 35 is provided for receipt of cable 29.

The use of transmission 32 allows much greater torque to be supplied to the shaft 26 with a small horsepower motor. In the preferred embodiment the motor is a one-quarter horsepower motor that inputs approximately 5,600 rpm to the transmission 32 and the transmission 32 output is about 700 to 800 rpm. This reduction in rpm from the motor 30 to the shaft 26 provides much greater torque to the spinner and the auger. The greater torque is desirable to prevent stalling of the motor due to clumping of the salt or other material in the hopper. The higher torque will tend to break apart clogs and keep the spreader operational.

The use of a transmission 32 and small compact motor 30 permits the entire drive assembly to be mounted outside of the hopper 14 and greatly reduces the amount of parts normally required for a spreader drive assembly. A typical spreader unit has at least 12 major parts and with the exception of the spinner, they are all mounted inside of the hopper 14. In contrast, the drive assembly of the present invention has three major parts, the shaft 26, the motor 30 and the transmission 32; all of which are mounted outside of the hopper. As should be appreciated, mounting a drive assembly inside a hopper filled with corrosive materials reduces the useful life of the drive assembly. Additionally, the numerous parts require continual maintenance and they are not easily accessible because of their location within the hopper. Still further, if repairs are required, the drive assembly has to be removed from the hopper. The present invention has low maintenance requirements because of the sealed motor 30 and transmission 32 and the location of these critical elements outside of the hopper. Any maintenance that is needed is simple because the parts to be maintained are all located outside the hopper 14 and can be accessed easily. Still further, in the event parts need to be replaced, the entire drive assembly 20 can be removed by removing a few bolts and dropping the drive assembly 20 as a unit out of the hopper outlet 22 and either fixing the problem or bolting a new drive assembly 20 in place. As will be appreciated by those of ordinary skill in the art, the ability for such rapid repair and servicing is not found in known spreaders.

Figure 5:
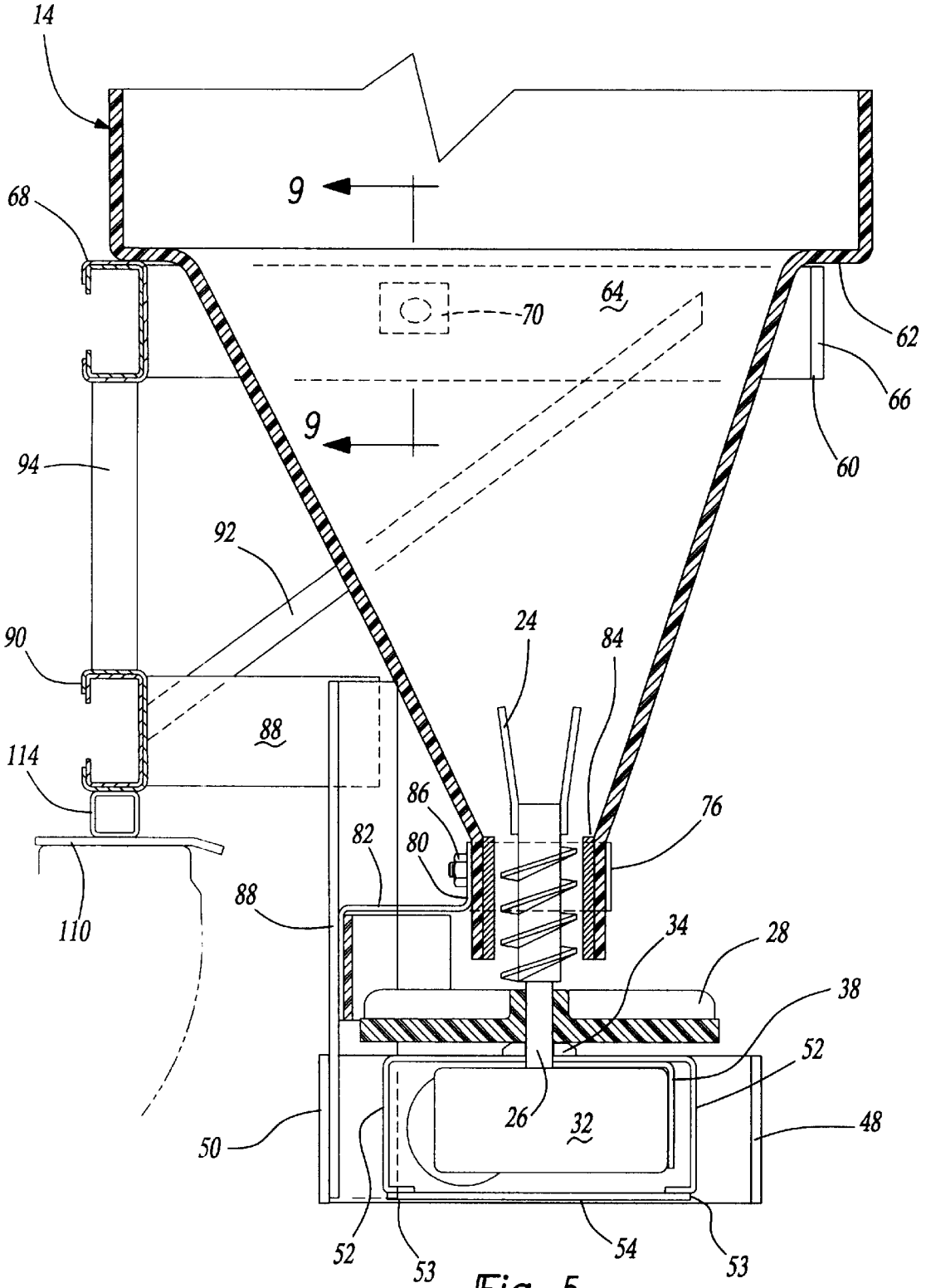
FIG. 5 is a cross-section of the spreader assembly of the present invention.
Figure 9:
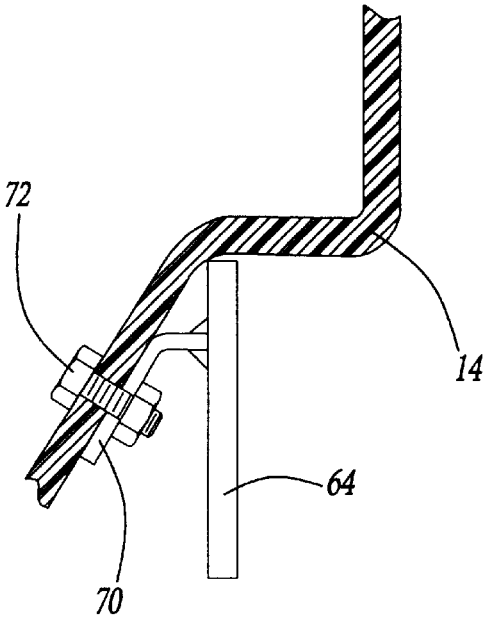
FIG. 9 is a view taken along FIG. 9—9 of FIG. 5.

With reference to FIGS. 4 and 5, the spreader frame 16 and the mounting frame 18 will be described. The spreader frame 16 has a main frame 60 which supports the hopper 14. As seen in FIG. 5, the hopper 14 has a support surface 62 which sits on the main frame 60. The main frame 60 includes side members 64 and a rear member 66. The front support surface is defined by main upper channel 68. With reference to FIGS. 4, 5, and 9, the hopper mounting brackets 70 are shown. A bolt and nut 72 fix the hopper 14 to the sidewall 64 through bracket 70.

The hopper outlet 22 is mounted through a bracket assembly to the lower support frame 74. The bracket assembly includes a tubing type clamp 76 and a bracket 78. Bracket 78 has a face 80 that receives bolts or screws to retain the clamp 76 and a body portion 82 for attachment to the lower support frame 74. The clamp is secured to the face 80 of the bracket 78 by for example nuts and bolts 86, see FIG. 5.

In the preferred embodiment, the hopper outlet 22 has a stainless steel insert 84 to allow the clamp 76 to be tightened securely around the hopper outlet 22. In addition, the stainless steel insert 84 provides greater strength to the hopper outlet 22 adjacent the auger 24 to allow the auger 24 to provide a continuous flow of material to the spinner 28. With the insert 84, the auger can force material against the wall of the insert 84 and break up clumped material without damaging the hopper outlet 22. Stainless steel is preferred for the insert 84 since it resists the corrosive nature of the material within the hopper 14.

In the disclosed embodiment, the lower support frame 74 includes support arms 88 for supporting the bracket 78 and through the bracket 78 the hopper 14. As disclosed, the support arms 88 are made of angle iron, but other types and shapes of supports could be used as will be obvious to those of ordinary skill in the art.

The lower support frame 74 is mounted to the main lower channel 90. The support arms 88 are either welded, bolted or otherwise attached to the main lower channel 90. Support braces 92 extend between the main lower channel 90 and the main frame 60 to give added support to the main spreader frame 16. Vertical supports 94 are provided between the upper channel 68 and the lower channel 90. A material deflector 96 and a spinner guard 98 are also illustrated in FIG. 4. The material defector 96 deflects material away from the back of the pick-up truck 12. The spinner guard 98 protects the spinner 28.

The vehicle mounting frame 18 includes a pivot channel assembly 100 and a latch channel assembly 102. The pivot channel assembly 100 and the latch channel assembly 102 are disclosed with each having a pair of channels 104 that are received by the upper channel 68 and the lower channel 90. In the preferred embodiment, the channels 104 are slid into the mating channels 68 and 90. In this way, the hopper assembly 10 can be easily adjusted to fit the rear of any vehicle. Because of the adjustability, the hopper assembly 10 is a one size fits all assembly. In the preferred embodiment, once the channels 104 are adjusted to the proper width by sliding them with respect to channels 68 and 90, holes are drilled through the channels 104 and the upper and lower main channels 68 and 90 to receive mounting screws or bolts. The mounting screws or bolts are shown at 101 of FIG. 6.

The pivot channel assembly 100 has pivot sleeves 106 mounted upon the free ends of the channels 104. The sleeves 106 are journaled on a pivot rod 108 which is mounted to a pivot bumper bracket 110. As illustrated, the bumper bracket 110 has a retaining cup 111 that receives the pivot rod 108 and supports the lower sleeve 106 as the spreader assembly pivots. In the preferred embodiment, the pivot bumper bracket 110 is bolted to the bumper of the vehicle 12 and is connected to the bed rails 112 through rail mounting brackets 134. This will be discussed in greater detail below. The sleeves 106 journaled upon the rod 108 allow the spreader assembly to pivot about the rod 108 and permits the vehicle tail gate to be opened without removing the spreader assembly 10 from the vehicle 12.

Figure 7:
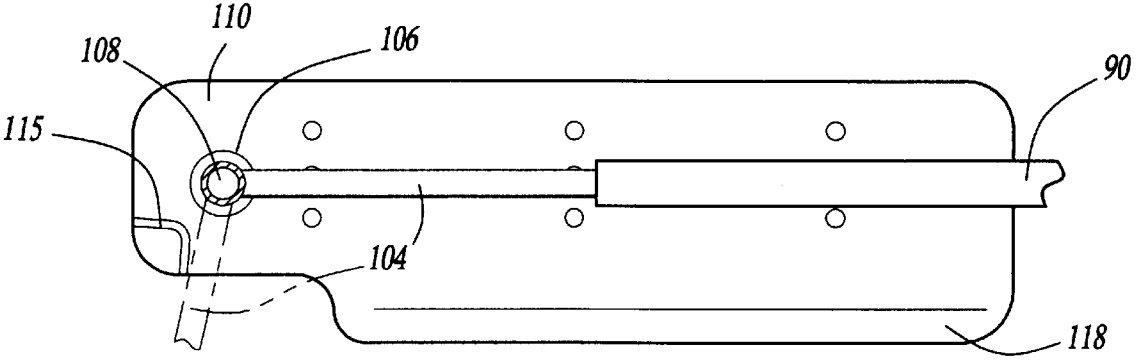
FIG. 7 is a top view of a bumper mounting bracket.

With reference to FIG. 7, a pivot stop 1 15 is mounted to the bracket 110 to prevent the spreader assembly 10 from swinging to far and hitting the side of the pick-up truck 12. The channel 104 engages the pivot stop 115 as the spreader assembly pivots about the pivot rod. As should be appreciated, the spreader assembly 10 can swing through about 90° as illustrated and if the pivot stop 115 is moved further around the pivot rod 108, a larger angle of rotation could be obtained.

Figure 6:
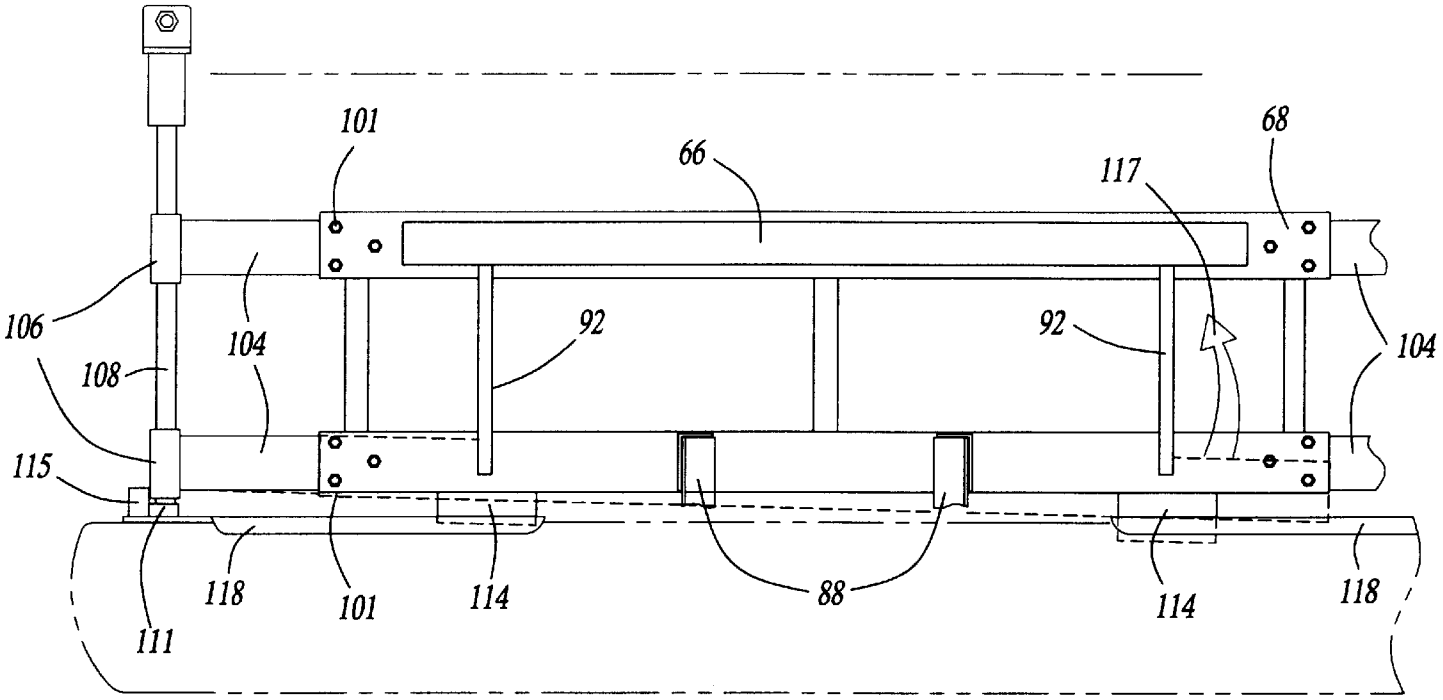
FIG. 6 is a partial view of the support frame of the present invention.

In the preferred embodiment, the spreader assembly 10 can only be opened when the hopper is empty to prevent damage to the pivot rod 108, the channels 104, the bumper of the vehicle and the bed rails 112. Pivoting is restricted by the rub bar 114 which engages the bumper bracket 110. This can be seen in FIG. 5. In order to pivot the hopper 14, the hopper 14 has to be raised to allow the rub bar 114 to clear the bumper bracket 110. Without lifting the spreader assembly 10, the spreader assembly 10 cannot pivot. The hopper assembly 10 can only be raised if the hopper 14 is empty. If the hopper 14 is empty it will not cause damage to swing the spreader assembly. With reference to FIG. 6, a pair of rub bars 114 are illustrated with each engaging a corresponding bracket 110 or 116. The arrow 117 illustrates the direction the spreader assembly 10 must be raised to allow the hopper assembly 10 to pivot. To facilitate the closing of the spreader assembly 10, the pivot bumper bracket 110 and the latch bumper bracket 116 have a ramp surface 118 to receive the rub bar 114 and start it onto the bumper brackets 110 and 116. It will be appreciated by those of ordinary skill in the art that only one rub bar may be necessary to protect against pivoting the spreader assembly 10 with a full hopper 14, even through two are illustrated.

With reference to FIG. 4, the latch channel assembly 102 has channels 104 with free ends that include a latch mechanism 120. The latch mechanism 120 includes a latch stop 122 and a latch pin 124. The latch pin 124 is mounted within an L-shaped groove 126 in channels 104 which allows the latch pin 124 to be moved into the latch position, at the foot of the L-shaped groove, and the unlatched position, opposite the foot. Each latch stop 122 has a pair of openings 128 that receive the latch pin 124. The latch stops 122 are U-shaped and the openings are across from one another. The U-shaped latch stops 122 engage the latching bar 130 which is mounted to and extends from the latch bumper bracket 116. The bar 130 has openings 132 that mate with the openings 128 in the latch stops 122. In operation, as the spreader assembly 10 is pivoted toward the tail gate of the vehicle 12, the latch stops 122 engage the latching bar 130 and the pins 124 can be moved to the latching position through the openings 128 and 132 to lock the spreader assembly 10 against the latch bar 130.

Figure 8:
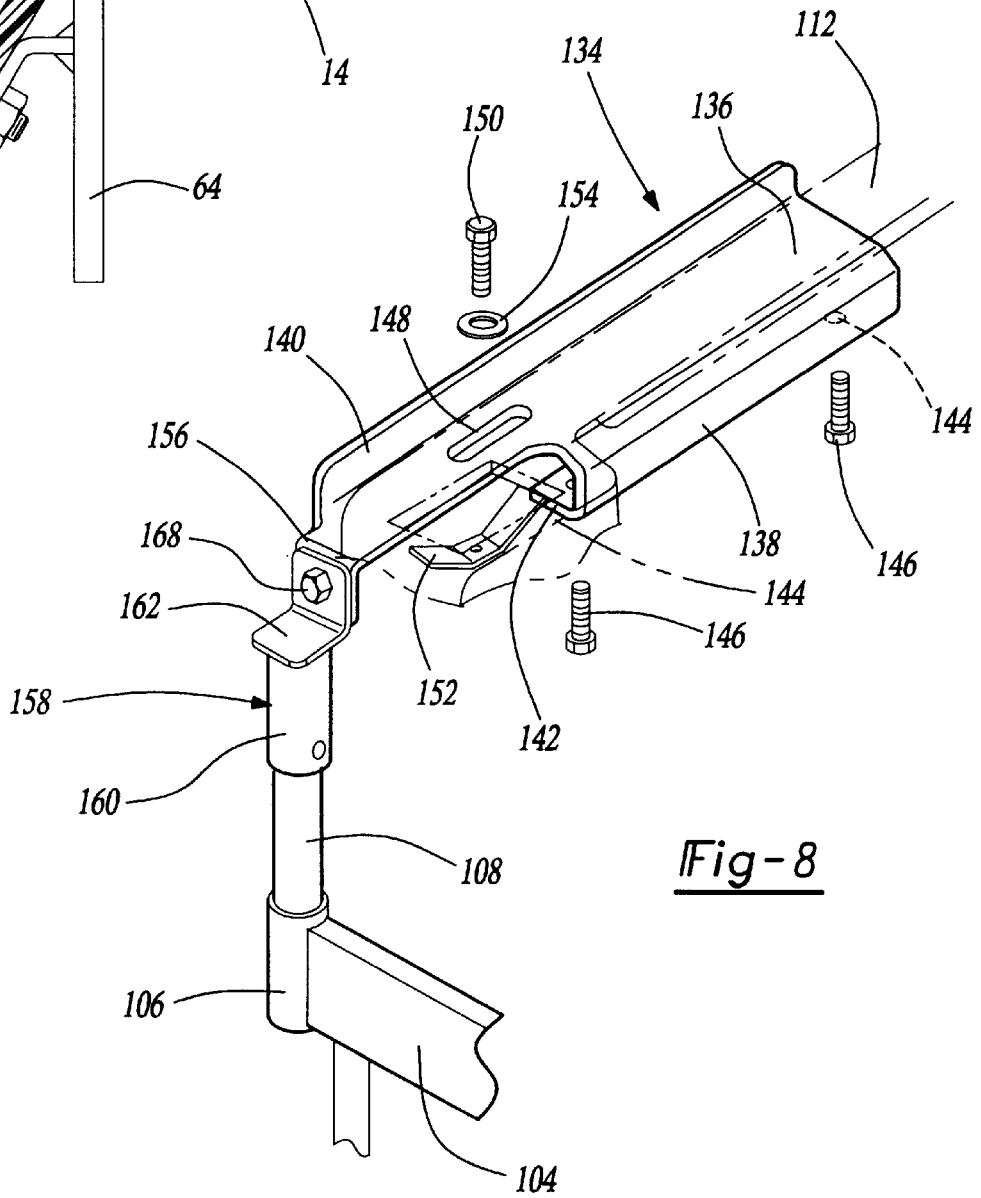
FIG. 8 is a perspective view of the rail mounting bracket attached to the pivot rod of the present invention.

With reference to FIG. 8, the rail mounting brackets 134 will be described. The left side mounting bracket 134, as viewed from the rear of the pick-up truck 12, is shown in FIG. 8. The right side mounting bracket 134 is the mirror image of the right side mounting bracket 134. The rail mounting bracket 134 permits the spreader assembly 10 to be mounted to the bed rails 112 without drilling holes in the bed rail 112. The mounting brackets 134 have a body portion 136, an underside retaining lip 138 and an upturned edge 140. The upturned edge 140 adds strength to the mounting bracket 134. The underside retaining lip 138 fits under the bed rail 112. As illustrated, the lip 138 is formed by bending the edge of the body portion 136 into a generally U-shape that has an underside leg 142 that adjoins the underside of the bed rail 112. The underside leg 142 has openings 144 that receive bolts 146. In the disclosed embodiment, the openings 144 are internally threaded to receive the bolts 146. By tightening the bolts 146, the bolts 146 engage the under side of the rail 112 to lock the rail brackets 134 to the rail 112.

A slotted opening 148 is formed in the body portion 136 for receipt of a bolt 150. The slot 148 is provided to allow the opening to be positioned over the stake pockets of the pick-up truck. A toggle 152 is inserted into the stake pocket to grab in the stake pocket as the bolt 150 is tightened. A washer 154 is provided between the bolt 150 and the body 136. Through both the toggle bolt 150 and 152 and the bolts 146, the rail mounting brackets 134 are securely mounted to the bed rails 112.

A connecting tab 156 is formed at the rear end of the rail mounting brackets 134. The connecting tabs of each rail mounting bracket 134 are attached to the pivot rod 108 and the latching bar 130. The pivot rod 108 has a connecting cap 158 for attachment to the end of rod 108 and to the tab. The cap 158 has a sleeve 160 and an angle member 162 attached to the end opposite the pivot rod 108. The angle member 162 has an opening 164 that mates with an opening 166 in the tab 156. The openings 164 and 166 receive a nut and bolt 168 to attach the rail mounting bracket 134 to the pivot rod 108 and the pivot bumper bracket 110. The mounting of the tab 156 to the angle member 162 through a single nut and bolt allows pivotal movement between the rail mounting bracket 134 and the pivot rod 108. This permits the easy relative adjustment of these two members to ensure a level solid attachment.

The right side rail mounting bracket has the same tab 156. The tab is connected to the latching bar 130 through an angle member 170. Member 170 has openings 172 in each of the sides of the angle member 170. One of the sides of the angle member 170 is mounted to an opening 174 in the latching bar 130 and the other opening 172 in the angle is connected to the opening 166 in the tab 156. The connection of the angle member 170 in this manner allows movement of the rail mounting bracket 134 and the latching rod 130 to pivot with respect to one another in two different planes to allow adjustment between these two members.

Referring to FIG. 4, the spreader 10 of the present invention has a hopper top 176. The top 176 is specially configured to take advantage of the air blowing over the vehicle to help keep the top 176 on the hopper 14. A problem with known spreaders is that the tops are blown off the hopper because of the air flowing over the vehicle. The present invention uses a latch 178 to latch the top 176 to the hopper 14 and sloping surfaces 180. The front surface 180 slopes upwardly and rearwardly. The side surfaces 182 slope upwardly and toward the center and the rear surface slopes upwardly and forwardly. With this shape, the air flowing over the top 176 creates pressure on the front surface 180 and as the air flows over the peak 186 a vacuum is formed over the rear surface 184 to further hold down the top. Additionally, the side surfaces 182 create the same effects as wind blows across the side surfaces 182.

In accordance with the provisions of the patent statutes, the present invention has been described in what is considered to represent the preferred embodiment. However, it should be noted that the invention can be practiced otherwise than as specifically illustrated and described without departing from the intended scope.

What is claimed is:

1. A spreader assembly for spreading material, said spreader assembly comprising:

a hopper for containing material to be spread, said hopper having an opening for receipt of material and an outlet for discharging material from said hopper;

a drive shaft;

an auger mounted to said drive shaft and extending into said outlet to facilitate the discharge of material from said hopper though said outlet;

a spinner mounted to said drive shaft and below said auger to receive material as it is augured out of said outlet and to throw the material over a large distribution area;

a drive mechanism mounted below said hopper to turn said drive shaft auger and said spinner, said drive mechanism and said spinner are mounted outside said hopper;

said drive mechanism includes a motor and a transmission, such that said transmission reduces the revolutions per minute generated by said motor as said motor powers said spinner and said auger, and increases the torque to said drive shaft, said drive mechanism, auger and spinner are a unit that can be disconnected and connected to said hopper as a single part.

2. The spreader of claim 1, wherein said motor and transmission are joined together into a single unit.

3. The spreader of claim 1, wherein said transmission is sealed to prevent contaminates from entering said transmission.

4. The spreader of claim 1, wherein said drive mechanism is mounted within an enclosure mounted outside said hopper.

5. The spreader of claim 1, wherein said hopper is mounted to a frame mounted to a vehicle.

* * * * *